US010939221B2

(12) United States Patent
Yu

(10) Patent No.: US 10,939,221 B2
(45) Date of Patent: Mar. 2, 2021

(54) AUDIO PROCESSING METHOD AND AUDIO PROCESSING SYSTEM

(71) Applicant: Realtek Semiconductor Corporation, Hsinchu (TW)

(72) Inventor: Teng-Hsiang Yu, New Taipei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 16/545,055

(22) Filed: Aug. 20, 2019

(65) Prior Publication Data

US 2020/0304934 A1 Sep. 24, 2020

(30) Foreign Application Priority Data

Mar. 21, 2019 (TW) ..... 108109843

(51) Int. Cl.
*H04S 7/00* (2006.01)
*H04R 5/04* (2006.01)

(52) U.S. Cl.
CPC ..... *H04S 7/302* (2013.01); *H04R 5/04* (2013.01); *H04S 7/305* (2013.01); *H04S 2400/15* (2013.01); *H04S 2420/01* (2013.01); *H04S 2420/03* (2013.01)

(58) Field of Classification Search
CPC ..... H04S 2400/11; H04S 2420/01; H04S 2400/01; H04S 7/30
USPC ..... 381/310, 309, 300, 12, 303
See application file for complete search history.

(56) References Cited

U.S. PATENT DOCUMENTS 9,197,977 B2 * 11/2015 Mahabub ..... H04S 7/30
2008/0205659 A1 * 8/2008 Fischer ..... H04R 25/407 381/23.1
2013/0251079 A1 * 9/2013 Miyahara ..... G10L 21/0208 375/346

* cited by examiner

*Primary Examiner* — Alexander Krzystan
(74) *Attorney, Agent, or Firm* — Locke Lord LLP; Tim Tingkang Xia, Esq.

(57) ABSTRACT

An audio processing method and an audio processing system are provided. In the audio processing method, an audio signal is first provided. Then, plural predetermined categories are provided. Then, a classification step is performed on the audio signal according to the predetermined categories. Thereafter, a transform step is performed on the audio signal to convert the audio signal into a frequency domain. Then, a panning step and a summing step are performed on amplitude signals of the audio signal to obtain a total amplitude signal. Thereafter, a separation step and a summing step are performed on phase signals of the audio signal to obtain a total phase signal. Then, an inverse transform step is performed on the total amplitude signal and the total phase signal to obtain an optimized audio signal in a time domain.

5 Claims, 7 Drawing Sheets

AUDIO PROCESSING METHOD AND AUDIO PROCESSING SYSTEM

RELATED APPLICATIONS

This application claims priority to Taiwan Application Serial Number 108109843, filed on Mar. 21, 2019, which is incorporated herein by reference.

BACKGROUND

Field of Invention

The present invention relates to an audio processing method and an audio processing system. More particularly, the present invention relates to an audio processing method and an audio processing system to allow the output audio signal to become broader and more spatial.

Description of Related Art

When a person hears an audio signal from a sound source, the audio signal usually reaches the left ear and the right ear of the person at two different times, thereby generating different sound levels. The human brain analyzes a difference between two different times and a difference between two different sound levels to produce an auditory scene. Stereo is one method for producing the auditory scene, which provides the audio signal to plural speakers through plural independent sound channels. These speakers are arranged in a symmetrical manner, so that the speakers may produce the auditory scene. In general, stereo is realized by dual soundtrack.

SUMMARY

The present invention provides an audio processing method and an audio processing system for optimizing the auditory scene of an audio signal.

One aspect of the invention is directed to an audio processing method. The audio processing method includes: providing an input audio signal; providing plural predetermined categories, in which the predetermined categories correspond to plural processing parameter groups in a one-to-one manner, each of the processing parameter groups comprises a panning angle curve, a separation curve and a weight parameter; performing a classification step on the input audio signal according to the predetermined categories, thereby obtaining at least one input audio category corresponding to the input audio signal, and the panning angle curve, the separation curve and the weight parameter which correspond to the input audio category, in which the at least one input audio category is at least one of the predetermined categories; performing a transformation step on the input audio signal to transform the input audio signal to frequency domain, thereby obtaining a amplitude signal and a phase signal corresponding to the input audio signal; performing a panning step on the amplitude signal according to the at least one input audio category of the input audio signal, and the panning angle curve and the weight parameter which correspond to the at least one input audio category, thereby obtaining at least one weighted panning amplitude signal of the input audio signal; performing a separation step on the phase signal according to the at least one input audio category of the input audio signal, and the separation curve and the weight parameter which correspond to the at least one input audio category, thereby obtaining at least one weighted separation phase signal of the input audio signal; when the number of the at least one weighted panning amplitude signal is 1 and the number of the at least one weighted separation phase signal is 1, an inverse transformation step is performed on the weighted panning amplitude signal and the weighted separation phase signal, thereby obtaining an optimized audio signal corresponding to time domain.

In accordance with one or more embodiments of the invention, the panning step includes: calculating a panning curve according to the panning angle curve corresponding to the at least one input audio category; multiplying the panning curve corresponding to the at least one input audio category by the weight parameter corresponding to the at least one input audio category, thereby obtaining a weighted panning curve corresponding to the at least one input audio category; and multiplying the amplitude signal by a corresponding weighted panning curve, thereby obtaining a weighted panning amplitude signal.

In accordance with one or more embodiments of the invention, the separation step includes: adding the phase signal to a corresponding separation curve, thereby obtaining a separation phase signal corresponding to the input audio signal; and multiplying the separation phase signal by a corresponding weight parameter, thereby obtaining a weighted separation phase signal.

In accordance with one or more embodiments of the invention, when the number of the at least one weighted panning amplitude signal is greater than 1 and the number of the at least one weighted separation phase signal is greater than 1, the weighted panning amplitude signals are added up to obtain a total amplitude signal, and the weighted separation phase signals are added up to obtain a total phase signal; and an inverse transformation step is performed on the total amplitude signal and the total phase signal, thereby obtaining an optimized audio signal corresponding to the time domain.

In accordance with one or more embodiments of the invention, the transformation step is Fourier transformation step, and the inverse transformation step is Inverse-Fourier Transformation step.

Another aspect of the invention is directed to an audio processing method. The audio processing method includes: providing an input audio signal, wherein the input audio signal comprises a left channel input signal and a right channel input signal; providing a plurality of predetermined categories, wherein the predetermined categories correspond to a plurality of processing parameter groups in a one-to-one manner, and each of the processing parameter groups comprises a panning angle curve, a first separation curve, a second separation curve and a weight parameter, wherein the first separation curve corresponds to a left channel, and the second separation curve corresponds to a right channel; performing a first classification step on the left channel input signal according to the predetermined categories, thereby obtaining at least one left channel audio category corresponding to the left channel input signal, and obtaining at least one left channel panning angle curve, at least one left channel separation curve and at least one left channel weight parameter which correspond to the left channel input signal according to the at least one left channel audio category; performing a second classification step on the right channel input signal according to the predetermined categories, thereby obtaining at least one right channel audio category corresponding to the right channel input signal, and obtaining at least one right channel panning angle curve, at least one right channel separation curve and at least one right channel weight parameter which correspond to the right channel input signal according to the at least one right channel audio category, wherein the at least one left channel audio category is at least one of the predetermined categories, and the at least one right channel audio category is at least one of the predetermined categories; performing a left channel audio signal adjusting step; and performing a right channel audio signal adjusting step. The left channel audio signal adjusting step includes: performing a first transformation step to transform the left channel input signal to frequency domain, thereby obtaining a left channel amplitude signal and a left channel phase signal which correspond to the left channel input signal; performing a first panning step on the left channel amplitude signal according to the at least one left channel panning angle curve and the at least one left channel weight parameter, thereby obtaining at least one left channel weighted panning amplitude signal of the left channel input signal; performing a first separation step on the left channel phase signal according to the at least one left channel separation curve and the at least one left channel weight parameter, thereby obtaining at least one left channel weighted separation phase signal of the left channel input signal; and wherein when the number of the at least one left channel weighted panning amplitude signal is 1 and the number of the at least one left channel weighted separation phase signal is 1, a first inverse transformation step is performed on the left channel weighted panning amplitude signal and the left channel weighted separation phase signal, thereby obtaining an optimized audio signal corresponding to time domain. The right channel audio signal adjusting step includes: performing a second transformation step to transform the right channel input signal to frequency domain, thereby obtaining a right channel amplitude signal and a right channel phase signal corresponding to the right channel input signal; performing a second panning step on the right channel amplitude signal according to the at least one right channel panning angle curve and the at least one right channel weight parameter which correspond to the right channel input signal, thereby obtaining at least one right channel weighted panning amplitude signal of the right channel input signal; performing a second separation step on the right channel phase signal corresponding to the right channel input signal according to the at least one right channel separation curve and the at least one right channel weight parameter which correspond to the right channel input signal, thereby obtaining at least one right channel weighted separation phase signal of the right channel input signal; and wherein when the number of the at least one right channel weighted panning amplitude signal is 1 and the number of the at least one right channel weighted separation phase signal is 1, a second inverse transformation step is performed on the right channel weighted panning amplitude signal and the right channel weighted separation phase signal, thereby obtaining an optimized right channel audio signal corresponding to time domain.

In accordance with one or more embodiments of the invention, when the number of the at least one left channel audio category is 1, the first panning step includes: calculating a left channel panning curve according to the at least one left channel panning angle curve; multiplying the left channel panning curve by the at least one left channel weight parameter, thereby obtaining a left channel weighted panning curve corresponding to the left channel input signal; and multiplying the left channel amplitude signal by a corresponding left channel weighted panning curve, thereby obtaining at least one left channel weighted panning amplitude signal.

In accordance with one or more embodiments of the invention, when the number of the at least one left channel audio category is 1, the first separation step includes: adding the left channel phase signal to the at least one left channel separation curve, thereby obtaining a left channel separation phase signal corresponding to the left channel input signal; and multiplying the left channel separation phase signal by a corresponding left channel weight parameter, thereby obtaining at least one left channel weighted separation phase signal.

In accordance with one or more embodiments of the invention, when the number of the at least one right channel audio category is 1, the second panning step includes: calculating a right channel panning curve according to the at least one right channel panning angle curve; multiplying the right channel panning curve by the at least one right channel weight parameter, thereby obtaining a right channel weighted panning curve corresponding to the right channel input signal; and multiplying the right channel amplitude signal by a corresponding right channel weighted panning curve, thereby obtaining at least one right channel weighted panning amplitude signal.

In accordance with one or more embodiments of the invention, when the number of the at least one right channel audio category is 1, the second separation step includes: adding the right channel phase signal to the at least one right channel separation curve, thereby obtaining a right channel separation phase signal corresponding to the right channel input signal; and multiplying the right channel separation phase signal by a corresponding right channel weight parameter, thereby obtaining a right channel weighted separation phase signal.

In accordance with one or more embodiments of the invention, when the number of the at least one left channel weighted panning amplitude signal is greater than 1 and the number of the at least one left channel weighted separation phase signal is greater than 1, the left channel weighted panning amplitude signals are added up to obtain a total left channel amplitude signal, and the left channel weighted separation phase signals are added up to obtain a total left channel phase signal; and a first inverse transformation step is performed on the total left channel amplitude signal and the total left channel phase signal, thereby obtaining an optimized left channel audio signal corresponding to time domain.

In accordance with one or more embodiments of the invention, when the number of the at least one right channel weighted panning amplitude signal is greater than 1 and the number of the at least one right channel weighted separation phase signal is greater than 1, the right channel weighted panning amplitude signals are added up to obtain a total right channel amplitude signal, and the right channel weighted separation phase signals are added up to obtain a total right channel phase signal; and a second inverse transformation step is performed on the total right channel amplitude signal and the total right channel phase signal, thereby obtaining an optimized right channel audio signal corresponding to time domain.

In accordance with one or more embodiments of the invention, each of the first transformation step and the second transformation step is Fourier transformation step, and each of the first inverse transformation step and the second inverse transformation step is Inverse-Fourier Transformation step.

Another aspect of the invention is directed to an audio processing system for processing an input audio signal, in which the input audio signal includes a left channel input signal and a right channel input signal. The audio processing system includes a classification circuitry, a transformation circuitry, a left channel panning circuitry, a right channel panning circuitry, a left channel broader circuitry, a right channel broader circuitry and an inverse transformation circuitry. The classification circuitry is configured to store plural processing parameter groups, in which the processing parameter groups correspond to a plurality of predetermined categories in a one-to-one manner, and each of the processing parameter group comprises a panning angle curve, a first separation curve which corresponds to a left channel, a second separation curve which corresponds to a right channel and a weight parameter, in which the classification circuitry is configured to perform a first classification step and a second classification step on the left channel input signal and the right channel input signal, thereby obtaining at least one left channel audio category, at least one left channel panning angle curve, at least one left channel separation curve and at least one left channel weight parameter which correspond to the left channel input signal, and obtaining at least one right channel audio category, at least one right channel panning curve, at least one right channel separation curve and at least one right channel weight parameter which correspond to the right channel input signal, in which the at least one left channel audio category is at least one of the predetermined categories, and the at least one right channel audio category is at least one of the predetermined categories. The transformation circuitry is configured to perform a transformation step on the left channel input signal and the right channel input signal to transform the left channel input signal and the right channel input signal to a frequency domain respectively, thereby obtaining a left channel amplitude signal and a left channel phase signal which correspond to the left channel input signal, and obtaining a right channel amplitude signal and a right channel phase signal which correspond to the right channel input signal. The left channel panning circuitry is configured to perform a first panning step on the left channel amplitude signal according to the at least one left channel panning angle curve and the at least one left channel weight parameter, thereby obtaining at least one left channel weighted panning amplitude signal of the left channel input signal. The right channel panning circuitry is configured to perform a second panning step on the right channel amplitude signal according to the at least one right channel panning angle curve and the at least one right channel weight parameter, thereby obtaining at least one right channel weighted panning amplitude signal of the right channel input signal. The left channel broader circuitry is configured to perform a first separation step on the left channel phase signal according to the at least one left channel separation curve and the at least one left channel weight parameter, thereby obtaining at least one left channel weighted separation phase signal of the left channel input signal. The right channel broader circuitry is configured to perform a second separation step on the right channel phase signal according to the at least one right channel separation curve and the at least one right channel weight parameter. When the number of the at least one left channel weighted panning amplitude signal is 1 and the number of the at least one left channel weighted separation phase signal is 1, the inverse transformation circuitry is configured to perform a first inverse transformation step on the left channel weighted panning amplitude signal and the left channel weighted separation phase signal, thereby obtaining an optimized left channel audio signal corresponding to the time domain. When the number of the at least one right channel weighted panning amplitude signal is 1 and the number of the at least one right channel weighted separation phase signal is 1, the inverse transformation circuitry is configured to perform a second inverse transformation step on the right channel weighted panning amplitude signal and the right channel weighted separation phase signal, thereby obtaining an optimized right channel audio signal corresponding to the time domain.

In accordance with one or more embodiments of the invention, when the number of the at least one left channel audio category is 1, the first panning step performed by the left channel panning circuitry further includes: calculating a left channel panning curve according to the at least one left channel panning angle curve; multiplying the left channel panning curve by the at least one left channel weight parameter, thereby obtaining a left channel weighted panning curve corresponding to the left channel input signal; and multiplying the left channel amplitude signal by a corresponding left channel weighted panning curve, thereby obtaining at least one left channel weighted panning amplitude signal.

In accordance with one or more embodiments of the invention, when the number of the at least one left channel audio category is 1, the first separation step performed by the left channel broader circuitry further includes: adding the left channel phase signal to the at least one left channel separation curve, thereby obtaining a left channel separation phase signal corresponding to the left channel input signal; and multiplying the left channel separation phase signal by the at least one left channel weight parameter, thereby obtaining a left channel weighted separation phase signal.

In accordance with one or more embodiments of the invention, when the number of the at least one right channel audio category is 1, the second panning step performed by the right channel panning circuitry further includes: calculating a right channel panning curve according to the at least one right channel panning angle curve; multiplying the right channel panning curve by the at least one right channel weight parameter, thereby obtaining a right channel weighted panning curve corresponding to the right channel input signal; and multiplying the left channel amplitude signal by a corresponding left channel weighted panning curve, thereby obtaining at least one left channel weighted panning amplitude signal.

In accordance with one or more embodiments of the invention, when the number of the at least one right channel audio category is 1, the second separation step performed by the right channel broader circuitry further includes: adding the right channel phase signal to the at least one right channel separation curve, thereby obtaining a right channel separation phase signal corresponding to the right channel input signal; and multiplying the right channel separation phase signal by the at least one right channel weight parameter, thereby obtaining a right channel weighted separation phase signal.

In accordance with one or more embodiments of the invention, the inverse transformation circuitry is further configured to: add the left channel weighted panning amplitude signals up to obtain a total left channel amplitude signal, and add the left channel weighted separation phase signals up to obtain a total left channel phase signal when the number of the at least one left channel weighted panning amplitude signal is greater than 1 and the number of the at least one left channel weighted separation phase signal is greater than 1; and perform a first inverse transformation step on the total left channel amplitude signal and the total left channel phase signal, thereby obtaining an optimized left channel audio signal corresponding to the time domain.

In accordance with one or more embodiments of the invention, the inverse transformation circuitry is further configured to: add the right channel weighted panning amplitude signals up to obtain a total right channel amplitude signal, and add the right channel weighted separation phase signals up to obtain a total right channel phase signal when the number of the at least one right channel weighted panning amplitude signal is greater than 1 and the number of the at least one right channel weighted separation phase signal is greater than 1; and add the right channel weighted panning amplitude signals up to obtain a total right channel amplitude signal, and add the right channel weighted separation phase signals up to obtain a total right channel phase signal when the number of the at least one right channel weighted panning amplitude signal is greater than 1 and the number of the at least one right channel weighted separation phase signal is greater than 1; and perform a second inverse transformation step on the total right channel amplitude signal and the total right channel phase signal, thereby obtaining an optimized right channel audio signal corresponding to the time domain.

BRIEF DESCRIPTION OF THE DRAWINGS

The invention can be more fully understood by reading the following detailed description of the embodiment, with reference made to the accompanying drawings as follows.

DETAILED DESCRIPTION

The using of "first", "second", etc. in the specification should be understood for identify units or data described by the same terminology, but is not referred to particular order or sequence.

Figure 1:
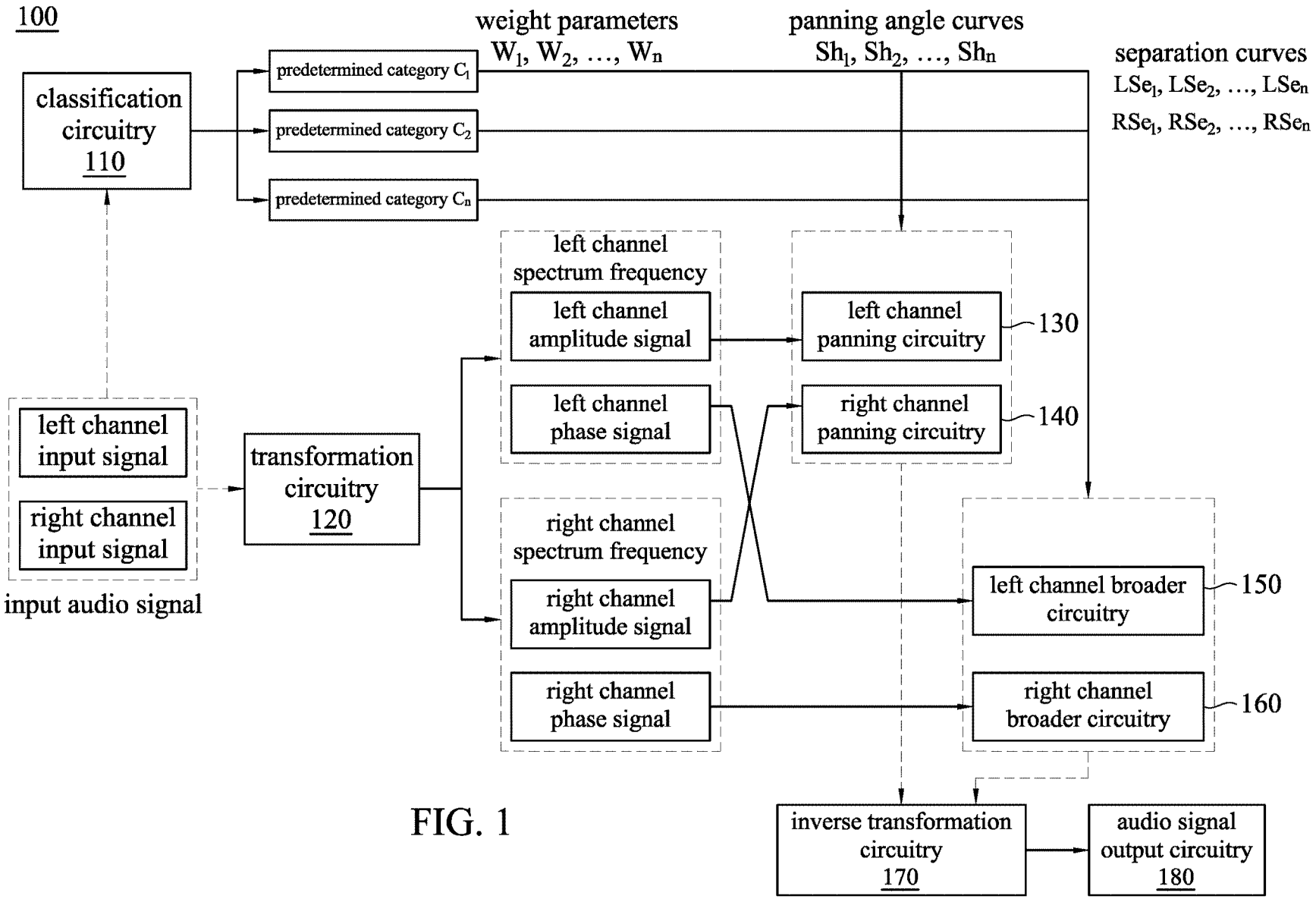
FIG. 1 illustrates a block diagram of an audio processing system according to an embodiment of the present invention.

Referring to FIG. 1, FIG. 1 illustrates a block diagram of an audio processing system 100 according to an embodiment of the present invention. The audio processing system 100 is configured to process an input audio signal from the outside, thereby optimizing its audio effect. The audio signal includes a left channel signal and a right channel signal. In the present embodiment, the audio signal can be composed of different types of audio signals. For convenience of explanation, the input audio signal of the following embodiment includes two different audio signals, such as speech and music, but embodiments of the present invention are not limited thereto.

The audio processing system 100 includes a classification circuitry 110, a transformation circuitry 120, a left channel panning circuitry 130, a right channel panning circuitry 140, a left channel broader circuitry 150, a right channel broader circuitry 160 and an inverse transformation circuitry 170. The classification circuitry 110 is configured to perform a classification step on the left channel signal and the right channel signal. In the embodiments of the present invention, classification circuitry 110 stores plural processing parameter groups and plural predetermined categories $C_1$-$C_n$, in which the processing parameter groups correspond to the predetermined categories in a one-to-one manner, and each of the predetermined categories represents one type category of audio signal, such as speech or music. In the embodiments of the present invention, the classification circuitry 110 can be realized by a machine learning technology, but embodiments of the present invention are not limited thereto.

Figure 2A:
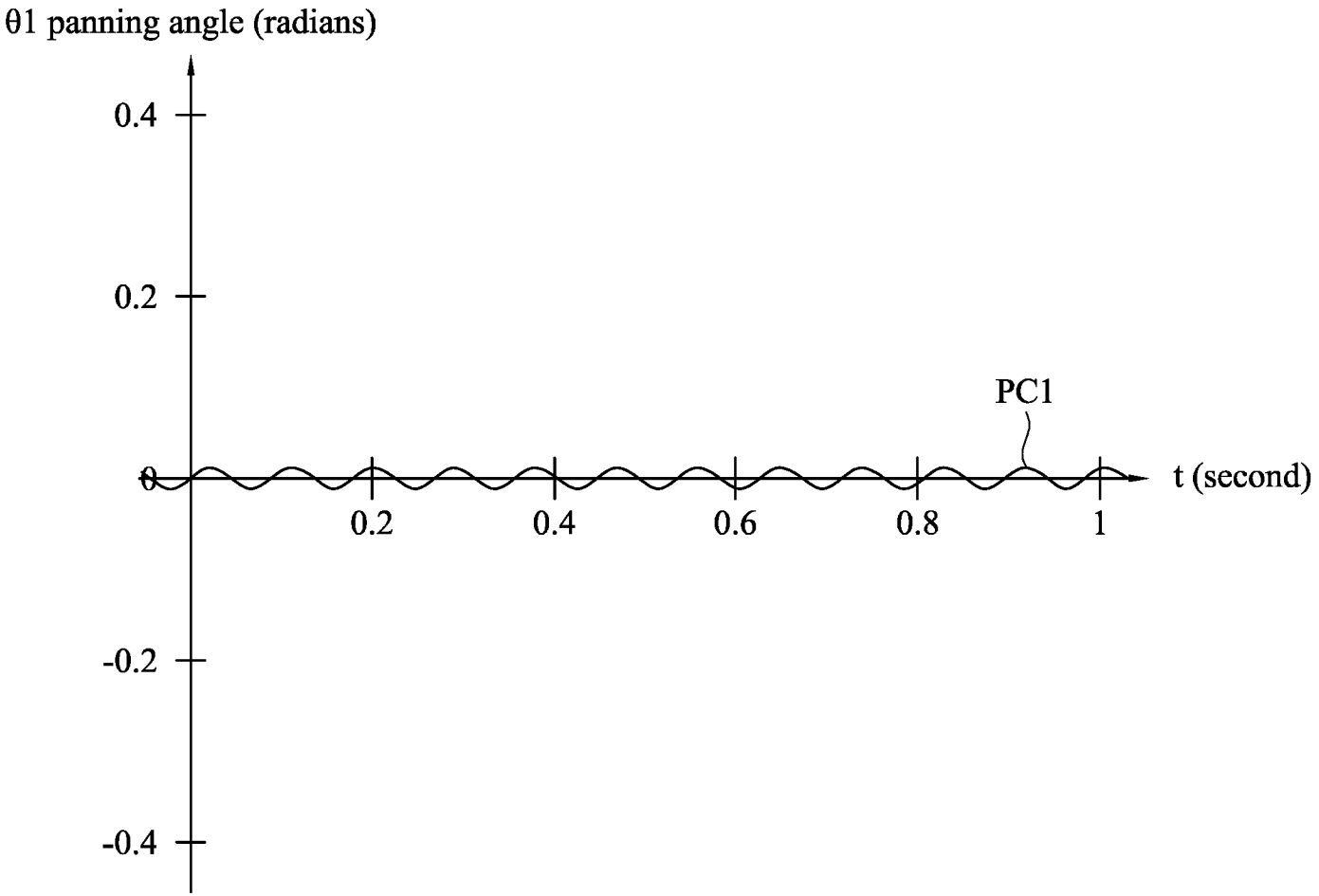
FIG. 2*a* illustrates a panning angle curve which corresponds to a category according to an embodiment of the present invention.
Figure 2B:
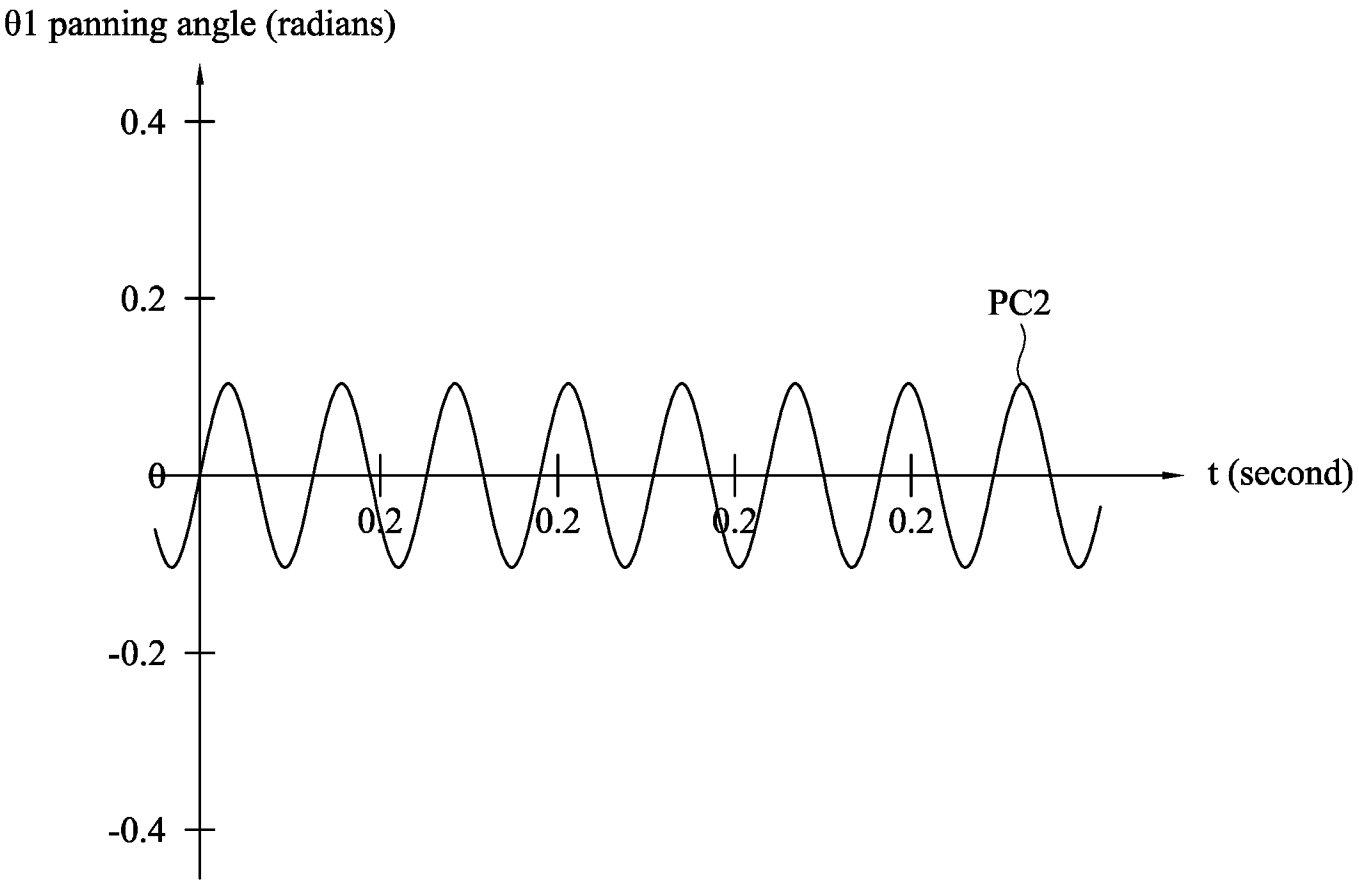
FIG. 2*b* illustrates a panning angle curve which corresponds to a category according to an embodiment of the present invention.

Each of the processing parameter groups includes a panning angle curve, a separation curve corresponding to the left channel, a separation curve corresponding to the right channel and a weight parameter. Simultaneously referring to FIG. 2*a* and FIG. 2*b*, FIG. 2*a* illustrates a panning angle curve PC1 which corresponds to a music category, and FIG. 2*b* illustrates a panning angle curve PC2 which corresponds to a speech category. In the FIG. 2*a* and FIG. 2*b*, the panning angle curves PC1 and PC2 demonstrate the relationship between time and panning angle, in which the panning angle represents an angle of the input audio signal in the left and right direction to indicate the directivity of the input audio signal. In the present embodiment, the panning angle curve PC1 represents a panning angle curve which corresponds to the music category, in which the panning angle curve PC1 may be expressed by the following formula:

$$\theta 1=0.01\times\sin 70t \tag{1}$$

θ1 represents the panning angle, and t represents the time. The panning angle curve PC2 represents a panning angle curve which corresponds to the speech category, in which the panning angle curve PC2 may be expressed by the following formula:

$$\theta 2=0.1\times\sin 50t \tag{2}$$

θ2 represents the panning angle. In the present embodiment, units of θ1 and θ2 are radians (rad).

From formulas (1) and (2), in the present embodiment, the panning angle curve PC1 corresponding to the music category and the panning angle curve PC2 corresponding to the speech category are sinusoidal functions, but embodiments of the present invention are not limited thereto.

Figure 2C:
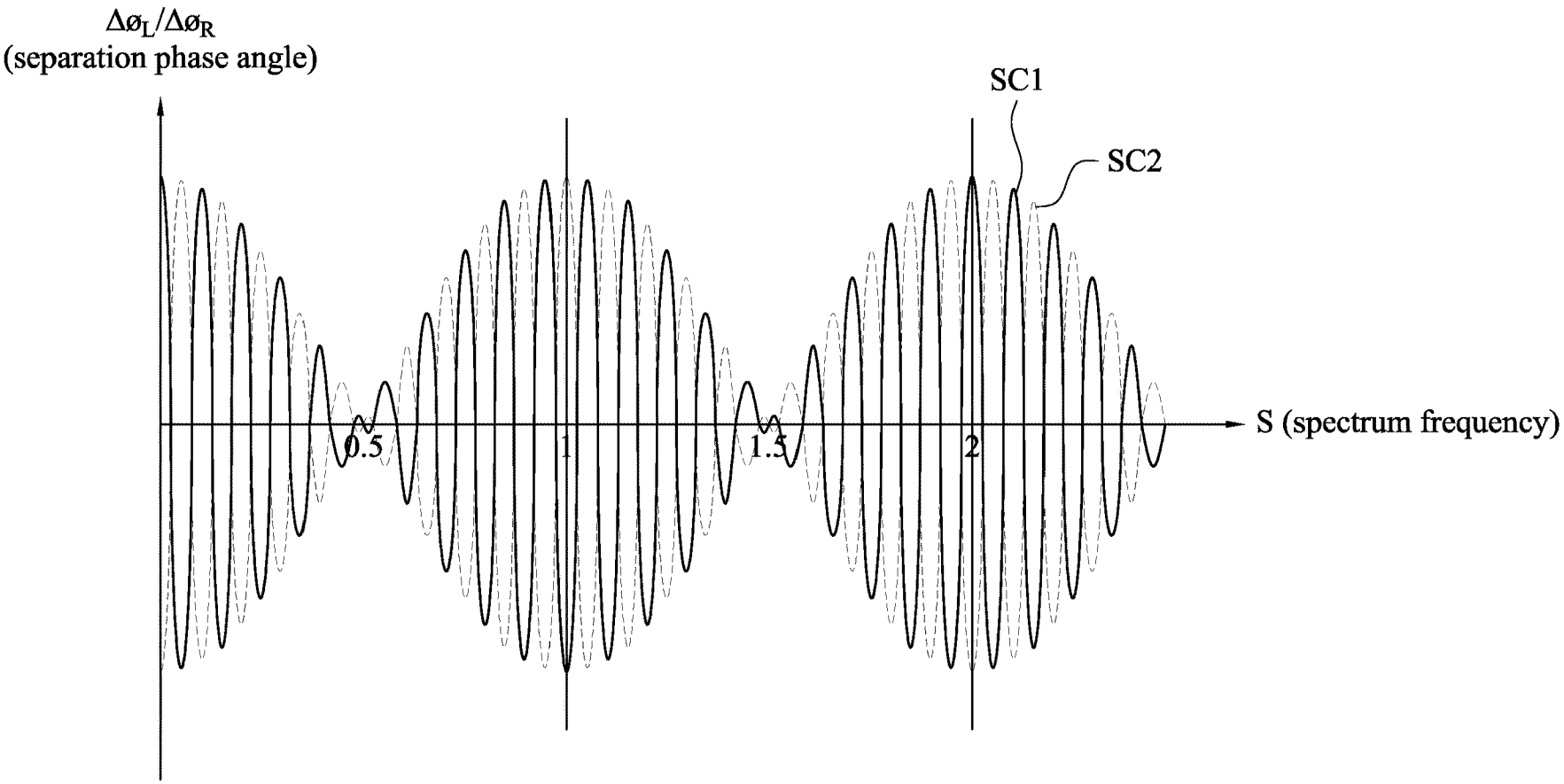
FIG. 2*c* illustrates a left channel separation curve and a right channel separation curve according to an embodiment of the present invention.

Referring to FIG. 2*c*, FIG. 2*c* illustrates a separation curve SC1 of the left channel and a separation curve SC2 of the right channel which correspond to the speech category. In the FIG. 2*c*, the left channel separation curve SC1 and the right channel separation curve SC2 demonstrate the relationship between separation phase angle and spectrum frequency S, in which the separation phase angle represents a difference between different phase angles corresponding to the audio signal at different frequencies. In the present embodiment, the left channel separation curve SC1 and the right channel separation curve SC2 are corresponded to the speech category, and the left channel separation curve SC1 may be expressed by the following formula:

$$\Delta\varnothing_L(S)=\varnothing_\Delta\cos(2\pi f_1 s)\cos(2\pi f_2 s) \tag{3}$$

$\Delta\varnothing_L$ represents the separation phase angle of the left channel, and $\varnothing_\Delta$ represents the maximum separation phase angle. $f_1$ and $f_2$ are preset frequency values and may be adjusted according to the user requirements. The right channel separation curve SC2 may be expressed by the following formula:

$$\Delta Ø_R(s) = -Ø_\Delta \cos(2\pi f_1 s)\cos(2\pi f_2 s) \quad (4)$$

$\Delta Ø_R$ represents the separation phase angle of the right channel. In an embodiment of the present invention, $Ø_\Delta = \pi/3$, $f_1 = 700$, $f_2 = 0.5$, but embodiments of the present invention are not limited thereto.

From formulas (3) and (4), in the present embodiment, the phases of the left channel separation curve SC1 and the right channel separation curve SC2 of embodiments of the present invention are opposite to each other, but embodiments of the present invention are not limited thereto. In addition, in the present embodiment, the left channel separation curve and the right channel separation curve which correspond to the music category are constant functions, and the constants of the constant functions are zero.

Therefore, the classification circuitry 110 stores predetermined categories $C_1$-$C_n$, panning angle curves $Sh_1$-$Sh_n$, left channel separation curves $LSe_1$-$LSe_n$, right channel separation curves $RSe_1$-$RSe_n$, and weight parameters $W_1$-$W_n$. The panning angle curve $Sh_1$, the left channel separation curve $LSe_1$, the right channel separation curve $RSe_1$, and the weight parameter $W_1$ constitute a processing parameter group which corresponds to the category $C_1$. The panning angle curve $Sh_2$, the left channel separation curve $LSe_2$, the right channel separation curve $RSe_2$, and the weight parameter $W_2$ constitute a processing parameter group which corresponds to the category $C_2$. The panning angle curve $Sh_n$, the left channel separation curve $LSe_n$, the right channel separation curve $RSe_n$, and the weight parameter $W_n$ constitute a processing parameter group which corresponds to the category $C_n$.

When the classification circuitry 110 performs a classification step on the left channel input signal and the right channel input signal, the classification circuitry 110 classifies the left channel input signal and the right channel input signal according to the predetermined categories C1-Cn. For example, the left channel input signal is classified to be corresponded to the speech category and music category. In other words, the left channel input signal includes audio component of the speech category and audio component of the music category. In another example, the right channel input signal is classified to be corresponded to the speech category and music category. In other words, the right channel input signal includes audio component of the speech category and audio component of the music category.

In one embodiment of the present invention, the classification circuitry 110 classifies the left channel input signal and the right channel input signal according to their audio features and provides different confidence values for different predetermined categories. The confidence values are the aforementioned weight parameters $W_1$-$W_n$.

Therefore, after the classification circuitry 110 performs the classification step on the left channel input signal, at least one category corresponding to the left channel input signal (hereinafter referred to as "left channel audio category"), the panning angle curve corresponding to the left channel audio category (hereinafter referred to as "left channel panning angle curve"), the separation curve corresponding to the left channel input signal (hereinafter referred to as "left channel separation curve") and the weight parameter corresponding to the left channel input signal (hereinafter referred to as "left channel weight parameter") are obtained. Similarly, after the classification circuitry 110 performs the classification step on the right channel input signal, at least one category corresponding to the right channel input signal (hereinafter referred to as "right channel audio category"), the panning angle curve corresponding to the right channel audio category (hereinafter referred to as "right channel panning angle curve"), the separation curve corresponding to the right channel input signal (hereinafter referred to as "right channel separation curve") and the weight parameter corresponding to the right channel input signal (hereinafter referred to as "right channel weight parameter") are obtained.

For example, the left channel input signal of the present embodiment is corresponded to the speech category $C_1$ and the music category $C_2$. In the speech category $C_1$, the left channel input signal is corresponded to the left channel panning angle curve $Sh_1$, the left channel separation curve $LSe_1$ and the left channel weight parameter $W_1$. In the music category $C_2$, the left channel input signal is corresponded to the left channel panning angle curve $Sh_2$, the left channel separation curve $LSe_2$ and the left channel weight parameter $W_2$. In another example, the right channel input signal of the present embodiment is corresponded to the speech category $C_1$ and the music category $C_2$. In the speech category $C_1$, the right channel input signal is corresponded to the right channel panning angle curve $Sh_1$, the right channel separation curve $RSe_1$ and the right channel weight parameter $W_1$. In the music category $C_2$, the right channel input signal is corresponded to the right channel panning angle curve $Sh_2$, the right channel separation curve $RSe_2$ and the right channel weight parameter $W_2$.

The transformation circuitry 120 performs a transformation step on the left channel input signal and the right channel input signal, to transform the left channel input signal and the right channel input signal to frequency domain, thereby obtaining a left channel amplitude signal and a left channel phase signal which correspond to the left channel input signal, and obtaining a right channel amplitude signal and a right channel phase signal which correspond to the right channel input signal. For example, the left channel input signal is transformed to a left channel amplitude signal LSA and a left channel phase signal LSP. In another example, the right channel input signal is transformed to a right channel amplitude signal RSA and a right channel phase signal RSP. In the present embodiment, the transformation circuitry 120 uses Fourier transform to transform the left channel input signal and the right channel input signal to the frequency domain, but embodiments of the present invention are not limited thereto.

The left channel panning circuitry 130 is configured to perform a first panning step on the left channel amplitude signal LSA, thereby correspondingly adjusting the directivity of the left channel input signal according to the category of the left channel input signal. In the embodiments of the present invention, after the classification circuitry 110 performs the classification step, the left channel input signal is corresponded to the left channel panning angle curve and the left channel weight parameter of the at least one category. In the first panning step, the left channel panning circuitry 130 calculates the left channel panning curve corresponding to the left channel input signal according to the left channel panning angle curve. The left channel panning curve $P_L(\theta)$ may be expressed by the following formula:

$$P_L(\theta) = \frac{\sqrt{2}}{2}(\cos\theta - \sin\theta) \quad (5)$$

$\theta$ represents the aforementioned panning angle, such as $\theta 1$ or $\theta 2$.

Thereafter, the left channel panning curve corresponding to the left channel input signal is multiplied by a corresponding left channel weight parameter, thereby obtaining a left channel weighted panning curve. Then, the left channel panning circuitry 130 multiplies the left channel amplitude signal LSA by a corresponding left channel weighted panning curve, thereby obtaining a left channel weighted panning amplitude signal. After the first panning step is performed, the left channel panning circuitry 130 further performs a first summing step to add up all the left channel weighted panning amplitude signals, thereby obtaining a total left channel amplitude signal.

For example, the left channel input signal is corresponded to the speech category $C_1$, and the left channel panning circuitry 130 calculates the left channel panning curve $P_L(Sh_1)$ according to the left channel panning angle curve $Sh_1$ and then multiplies the left channel panning curve by the left channel weight parameter $W_1$, thereby obtaining the left channel weighted panning curve ($W_1*P_L(Sh_1)$). Thereafter, the left channel amplitude signal LSA is multiplied by the left channel weighted panning curve, thereby obtaining the left channel weighted panning amplitude signal ($LSA*W_1*P_L(Sh_1)$). In another example, the left channel input signal is also corresponded to the music category $C_2$, and the left channel panning circuitry 130 calculates the left channel panning curve $P_L(Sh_2)$ according to the left channel panning angle curve $Sh_2$ and then multiplies the left channel panning curve by the left channel weight parameter $W_2$, thereby obtaining the left channel weighted panning curve ($W_2*P_L(Sh_2)$). Thereafter, the left channel amplitude signal LSA is multiplied by the left channel weighted panning curve, thereby obtaining another left channel weighted panning amplitude signal ($LSA*W_2*P_L(Sh_2)$). Then, the left channel panning circuitry 130 adds up the aforementioned left channel weighted panning amplitude signals, thereby obtaining the total left channel amplitude signal ($LSA*W_1*P_L(Sh_1)+LSA*W_2*P_L(Sh_2)$).

In other embodiments of the present invention, the left channel panning circuitry 130 first multiplies the left channel panning curve by the left channel amplitude signal LSA and further multiplies the product of the left channel panning curve and the left channel amplitude signal LSA by the left channel weight parameter. In addition, if the left channel input signal corresponds to only one category, it means that only one left channel weighted panning amplitude signal is generated by the left channel panning circuitry 130. Therefore, the left channel panning circuitry 130 will omit the above-mentioned summing step.

The function of the right channel panning circuitry 140 is similar to the function of the right channel panning circuitry 130. The right channel panning circuitry 140 is configured to perform a second panning step on the right channel amplitude signal RSA corresponding to the right channel input signal, thereby correspondingly adjusting the directivity of the right channel input signal according to the category of the right channel input signal. In the embodiments of the present invention, after the classification circuitry 110 performs the classification step, the right channel input signal is corresponded to the right channel panning angle curve and the right channel weight parameter of the at least one category. In the second panning step, the right channel panning circuitry 140 calculates the right channel panning curve according to the right channel panning angle curve. The right channel panning curve $P_R(\theta)$ may be expressed by the following formula:

$$P_R(\theta) = \frac{\sqrt{2}}{2}(\cos\theta + \sin\theta) \tag{6}$$

$\theta$ represents the aforementioned panning angle, such as $\theta 1$ or $\theta 2$.

Thereafter, the right channel panning curve corresponding to the right channel input signal is multiplied by a corresponding right channel weight parameter, thereby obtaining a right channel weighted panning curve. Then, the right channel panning circuitry 140 multiplies the right channel amplitude signal RSA corresponding to the right channel input signal by a corresponding right channel weighted panning curve, thereby obtaining a right channel weighted panning amplitude signal. After the second panning step is performed, the right channel panning circuitry 140 further performs a second summing step to add up all the right channel weighted panning amplitude signals, thereby obtaining a total right channel amplitude signal.

For example, the right channel input signal is corresponded to the speech category $C_1$, and the right channel panning circuitry 140 calculates the right channel panning curve $P_R(Sh_1)$ according to the right channel panning angle curve $Sh_1$ and then multiplies the right channel panning curve by the right channel weight parameter $W_1$, thereby obtaining the right channel weighted panning curve ($W_1*P_R(Sh_1)$). Thereafter, the right channel amplitude signal RSA is multiplied by the right channel weighted panning curve, thereby obtaining the right channel weighted panning amplitude signal ($RSA*W_1*P_R(Sh_1)$). In another example, the right channel input signal is also corresponded to the music category $C_2$, and the right channel panning circuitry 140 calculates the right channel panning curve $P_R(Sh_2)$ according to the right channel panning angle curve $Sh_2$ and then multiplies the right channel panning curve by the right channel weight parameter $W_2$, thereby obtaining the right channel weighted panning curve ($W_2*P_R(Sh_2)$). Thereafter, the right channel amplitude signal RSA is multiplied by the right channel weighted panning curve, thereby obtaining another right channel weighted panning amplitude signal ($RSA*W_2*P_R(Sh_2)$). Then, the right channel panning circuitry 140 adds up the aforementioned right channel weighted panning amplitude signals, thereby obtaining the total right channel amplitude signal ($RSA*W_1*P_R(Sh_1)+RSA*W_2*P_R(Sh_2)$).

In other embodiments of the present invention, the right channel panning circuitry 140 first multiplies the right channel panning curve by the right channel amplitude signal RSA and further multiplies the product of the right channel panning curve and the right channel amplitude signal RSA by the right channel weight parameter. In addition, if the right channel input signal corresponds to only one category, it means that only one right channel weighted panning amplitude signal is generated by the right channel panning circuitry 140. Therefore, the right channel panning circuitry 140 will omit the above-mentioned summing step.

The left channel broader circuitry 150 is configured to perform a first separation step on the left channel phase signal corresponding to the left channel input signal, thereby adjusting the sound space of the left channel input signal according to the category corresponding to the left channel input signal. In the embodiments of the present invention, the left channel input signal is corresponded to at least one category and its left channel separation curve and left channel weight parameter. In the first separation step, the left channel broader circuitry 150 adds the left channel phase signal LSP to the left channel separation curve corresponding to the left channel input signal, thereby obtaining a left channel separation phase signal corresponding to the left channel input signal. Then, the left channel broader circuitry 150 multiplies the left channel separation phase signal corresponding to the left channel input signal by the left channel weight parameter, thereby obtaining a left channel weighted separation phase signal. After the first separation step is performed, the left channel broader circuitry 150 further performs a third summing step to add up all the left channel weighted separation phase signals, thereby obtaining a total left channel phase signal.

For example, the left channel input signal is corresponded to the speech category $C_1$, and the left channel broader circuitry 150 adds the left channel phase signal LSP and the left channel separation curve $LSe_1$, thereby obtaining the left channel separation phase signal ($LSP+LSe_1$). Thereafter, the left channel separation phase signal is multiplied by the left channel weight parameter, thereby obtaining the left channel weighted separation phase signal ($(LSP+LSe_1)*W_1$). In another example, the left channel input signal is also corresponded to the music category $C_2$, and the left channel broader circuitry 150 adds the left channel phase signal LSP to the left channel separation curve $LSe_2$, thereby obtaining the left channel separation phase signal ($LSP+LSe_2$). Then, the left channel separation phase signal is multiplied by the left channel weight parameter, thereby obtaining left channel weighted separation phase signal ($(LSP+LSe_2)*W_2$). Then, the left channel broader circuitry 150 adds up the aforementioned left channel weighted separation phase signals, thereby obtaining the total eft channel phase signal ($(LSP+LSe_1)*W_1+(LSP+LSe_2)*W_2$).

In addition, if the left channel input signal corresponds to only one category, it means that only one left channel weighted separation phase signal is generated by the left channel broader circuitry 150. Therefore, the left channel broader circuitry 150 will omit the above-mentioned summing step.

The right channel broader circuitry 160 is similar to the left channel broader circuitry 150. The right channel broader circuitry 160 is configured to perform a second separation step on the right channel phase signal corresponding to the right channel input signal, thereby adjusting the sound space of the right channel input signal according to the category corresponding to the right channel input signal. In the embodiments of the present invention, the right channel input signal is corresponded to at least one category and its right channel separation curve and right channel weight parameter. In the second separation step, the right channel broader circuitry 160 adds the right channel phase signal RSP to the right channel separation curve corresponding to the right channel input signal, thereby obtaining a right channel separation phase signal corresponding to the right channel input signal. Then, the right channel broader circuitry 160 multiplies the right channel separation phase signal corresponding to the right channel input signal by the corresponded left channel weight parameter, thereby obtaining a right channel weighted separation phase signal. After the second separation step is performed, the right channel broader circuitry 160 further performs a fourth summing step to add up all the right channel weighted separation phase signals, thereby obtaining a total right channel phase signal.

For example, the right channel input signal is corresponded to the speech category $C_1$, and the right channel broader circuitry 160 adds the right channel phase signal RSP and the right channel separation curve $RSe_1$, thereby obtaining the right channel separation phase signal ($RSP+RSe_1$). Thereafter, the right channel separation phase signal is multiplied by the right channel weight parameter, thereby obtaining the right channel weighted separation phase signal ($(RSP+RSe_1)*W_1$). In another example, the right channel input signal is also corresponded to the music category $C_2$, and the right channel broader circuitry 160 adds the right channel phase signal RSP to the right channel separation curve $RSe_2$, thereby obtaining the right channel separation phase signal ($RSP+RSe_2$). Then, the right channel separation phase signal is multiplied by the right channel weight parameter, thereby obtaining the right channel weighted separation phase signal ($(RSP+RSe_2)*W_2$). Then, the right channel broader circuitry 160 adds up the right channel weighted separation phase signals, thereby obtaining the total right channel phase signal ($(RSP+RSe_1)*W_1+(RSP+RSe_2)*W_2$).

In addition, if the right channel input signal corresponds to only one category, it means that only one right channel weighted separation phase signal is generated by the right channel broader circuitry 160. Therefore, the right channel broader circuitry 160 will omit the above-mentioned summing step.

The inverse transformation circuitry 170 is configured to perform an inverse transformation step on the total left channel amplitude signal, the total left channel phase signal, the total right channel amplitude signal and the total right channel phase signal, thereby obtaining an optimized left channel audio signal and an optimized right channel audio signal which correspond to the time domain. For example, the inverse transformation circuitry 170 is configured to perform the inverse transformation step on the total left channel amplitude signal and the total left channel phase signal, thereby obtaining an optimized left channel audio signal. In another example, the inverse transformation circuitry 170 is configured to perform an inverse transformation step on the total right channel amplitude signal and the total right channel phase signal, thereby obtaining an optimized right channel audio signal. In the present embodiment, the inverse transformation step is inverse-Fourier transform, but embodiments of the present invention are not limited thereto.

In one embodiment of the present invention, when the left channel input signal corresponds to only one category, it means that there is only one left channel weighted panning amplitude signal and only one left channel weighted separation phase signal. Therefore, the inverse transformation circuitry 170 will perform the aforementioned inverse transformation step on the left channel weighted panning amplitude signal and the left channel weighted separation phase signal. Similarly, in other embodiment of the present invention, when the right channel input signal corresponds to only one category, it means that there is only one right channel weighted panning amplitude signal and only one right channel weighted separation phase signal. Therefore, the inverse transformation circuitry 170 will perform the aforementioned inverse transformation step on the right channel weighted panning amplitude signal and the right channel weighted separation phase signal.

In other embodiments of the present invention, an audio signal output circuitry 180 is used to output the optimized left channel audio signal and the optimized right channel audio signal. In the present embodiment, the audio signal output circuitry 180 is a sound card, but the present invention is not limited thereto.

It may be seen from the above embodiments of the present invention that the audio processing system 100 is configured to classify the input audio signal, so as to process different predetermined categories according to different processing parameter groups, thereby the optimizing audio effect of the input audio signal. Because the processing parameter group includes the panning curves, separation curves and weight parameters, the audio processing system 100 can make the stereo audio effect and the broad effect of the input audio signal to be more obvious and enable the left channel and the right channel to switch more smoothly.

Figure 3:
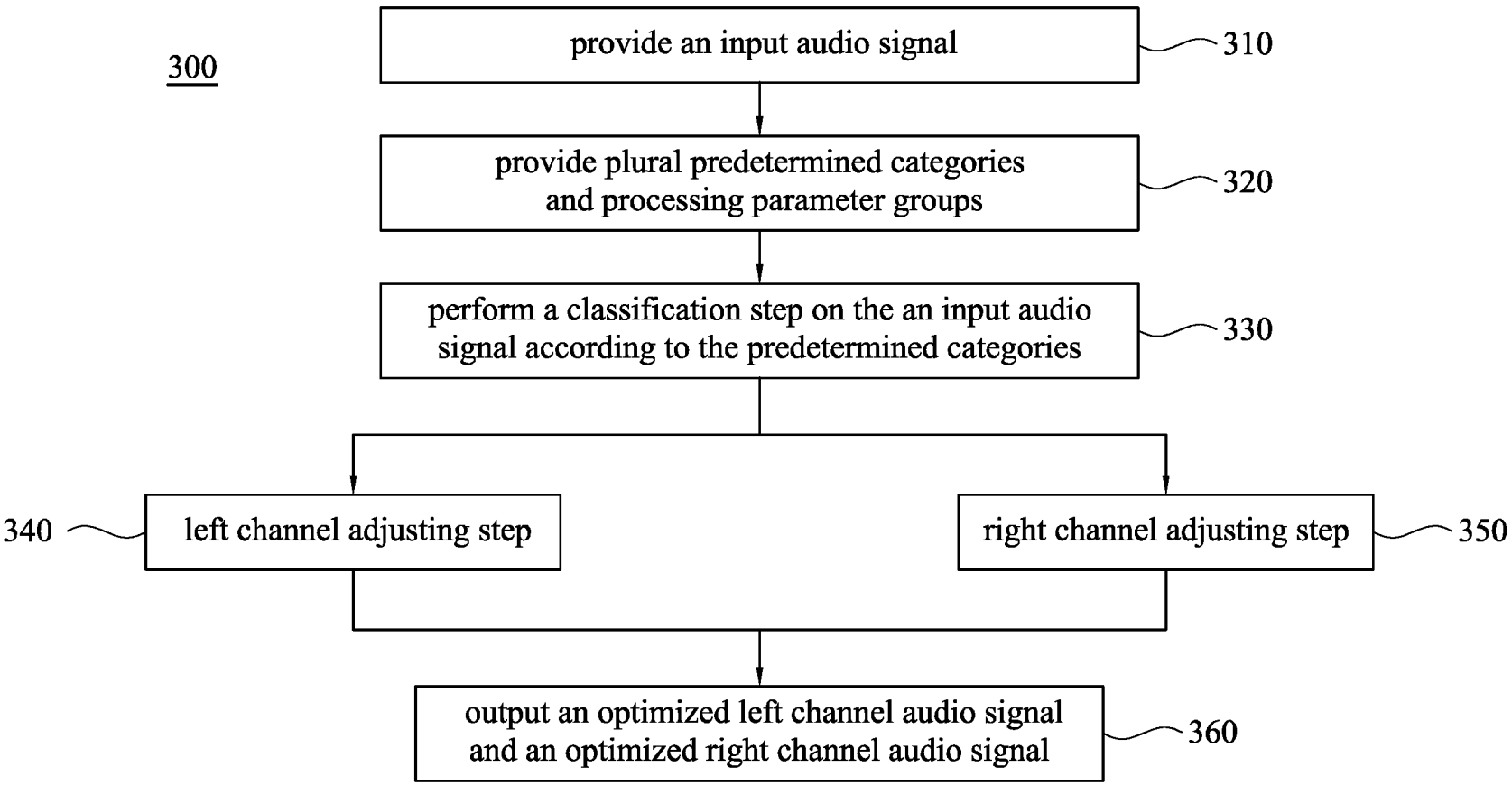
FIG. 3 illustrates a flow chart of an audio processing method according to an embodiment of the present invention.

Referring to FIG. 3, FIG. 3 illustrates a flow chart of an audio processing method 300 corresponding to the audio processing system 100 according to an embodiment of the present invention. Regarding the audio processing method 300, a step 310 is first performed to provide the input audio signal. Then, a step 320 is performed to provide plural predetermined categories and processing parameter groups. In the embodiments of the present invention, these predetermined categories and processing parameter groups are preset in the classification circuitry 110. Thereafter, a step 330 is performed to classify the input audio signal according to the predetermined categories. In the embodiments of the present invention, the step 330 is performed by the classification circuitry 110. Then, a left channel adjusting step 340 and a right channel adjusting step 350 are respectively performed, thereby obtaining the optimized left channel audio signal and the optimized right channel audio signal. Thereafter, a step 360 is performed to output the optimized left channel audio signal and the optimized right channel audio signal.

Figure 4:
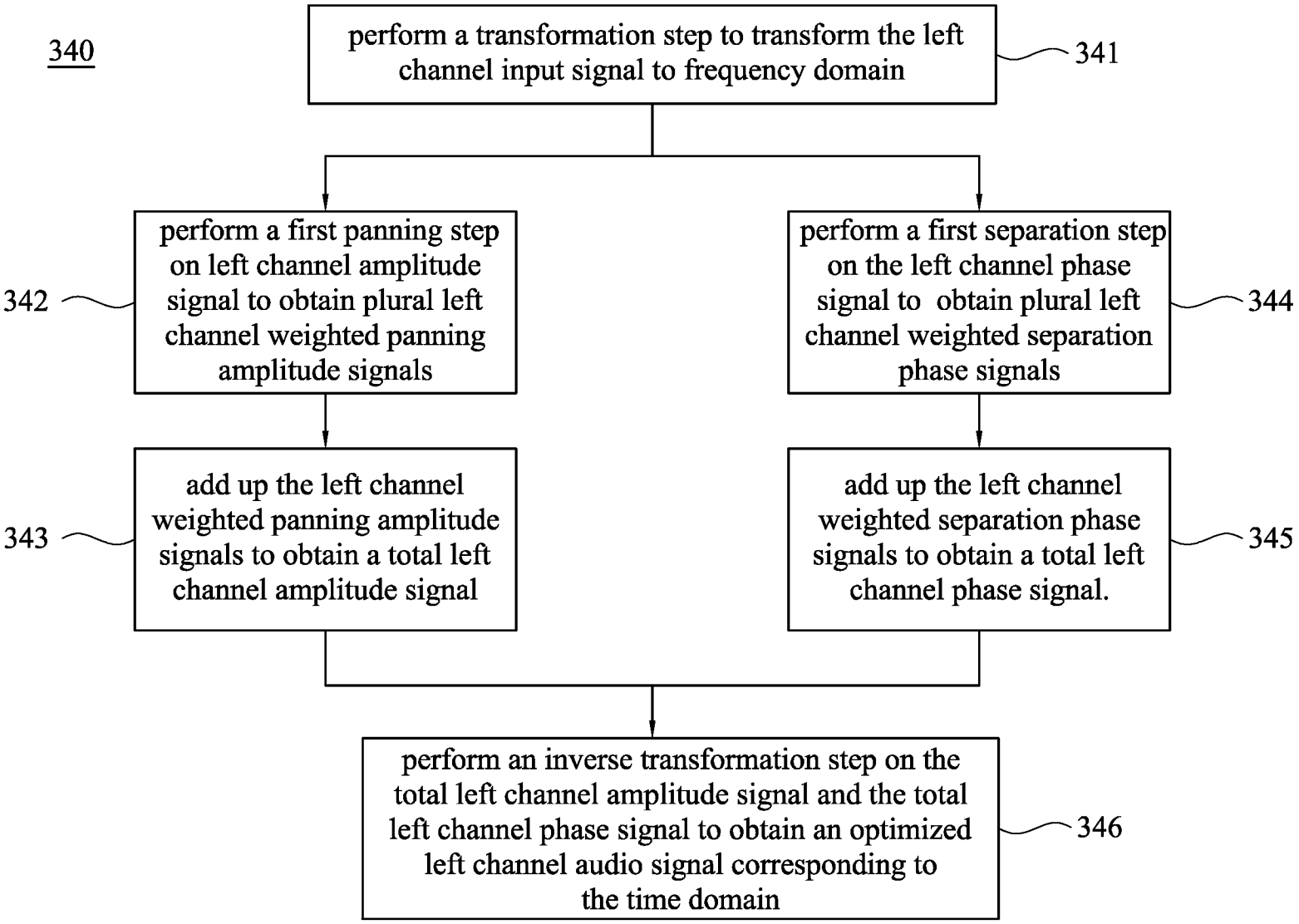
FIG. 4 illustrates a flow chart of a left channel adjusting step according to an embodiment of the present invention.

Referring to FIG. 4, FIG. 4 illustrates a flow chart of the left channel adjusting step 340 according to an embodiment of the present invention. In the left channel adjusting step 340, a step 341 is first performed to perform the aforementioned transformation step to transform the left channel input signal to frequency domain. Then, steps 342-343 and steps 344-345 are performed to process the spectrum frequency of the left channel input signal by using the processing parameter groups. In the step 342, the first panning step is performed on the left channel amplitude signal, thereby obtaining plural left channel weighted panning amplitude signals. Then, in the step 343, the left channel weighted panning amplitude signals are added up to obtain the total left channel amplitude signal. In the embodiments of the present invention, the steps 342-343 are performed by the left channel panning circuitry 130. In the step 344, the first separation step is performed on the left channel phase signal, thereby obtaining plural left channel weighted separation phase signals. Then, in the step 345, the left channel weighted separation phase signals are added up to obtain the total left channel phase signal. In the embodiments of the present invention, the steps 344-345 are performed by the left channel broader circuitry 150. After the steps 342-345 are performed, a step 346 is performed to perform the inverse transformation step on the total left channel amplitude signal and the total left channel phase signal, thereby obtaining the optimized left channel audio signal corresponding to the time domain. In the embodiments of the present invention, the step 346 is performed by the inverse transformation circuitry 170. In addition, if the left channel input signal corresponds to only one category, the number of the left channel weighted panning amplitude signal and the number of the left channel weighted separation phase signal are respectively 1. Therefore, the aforementioned steps 343 and 345 can be omitted, and the step 346 is performed to perform the inverse transformation step on the left channel weighted panning amplitude signal and the left channel weighted separation phase signal.

Figure 5:
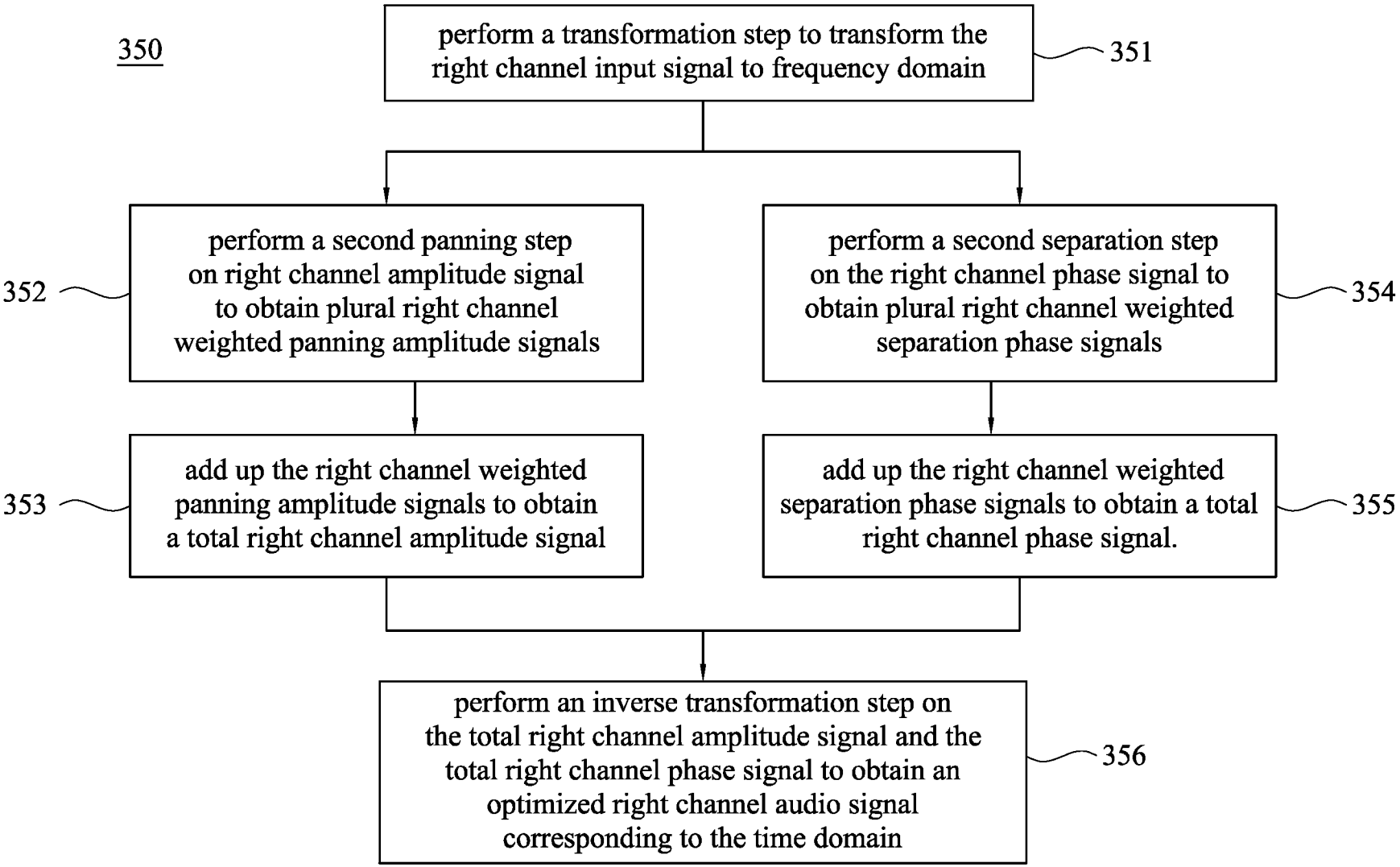
FIG. 5 illustrates a flow chart of a right channel adjusting step according to an embodiment of the present invention.

Referring to FIG. 5, FIG. 5 illustrates a flow chart of the right channel adjusting step 350 according to an embodiment of the present invention. In the right channel adjusting step 350, a step 351 is first performed to perform the aforementioned transformation step to transform the right channel input signal to frequency domain. Then, steps 352-353 and steps 354-355 are performed to process the spectrum frequency of the right channel input signal by using the processing parameter groups. In the step 352, the second panning step is performed on the right channel amplitude signal, thereby obtaining plural right channel weighted panning amplitude signal. Then, in the step 353, the right channel weighted panning amplitude signals are added up to obtain the total right channel amplitude signal. In the embodiments of the present invention, the steps 352-353 are performed by the right channel panning circuitry 140. In the step 354, the second separation step is performed on the right channel phase signal, thereby obtaining plural right channel weighted separation phase signals. Then, in the step 355, the right channel weighted separation phase signals are added up to obtain the total right channel phase signal. In the embodiments of the present invention, the steps 354-355 are performed by the right channel broader circuitry 160. After the steps 352-355 are performed, a step 356 is performed to perform the inverse transformation step on the total left channel amplitude signal and the total left channel phase signal, thereby obtaining the optimized right channel audio signal corresponding to the time domain. In the embodiments of the present invention, the step 356 is performed by the inverse transformation circuitry 170.

In addition, if the right channel input signal corresponds to only one category, the number of the right channel weighted panning amplitude signal and the number of the right channel weighted separation phase signal are respectively 1. Therefore, the aforementioned steps 353 and 355 can be omitted, and the step 356 is performed to perform the inverse transformation step on the right channel weighted panning amplitude signal and the right channel weighted separation phase signal.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An audio processing method, comprising:

providing an input audio signal;

providing a plurality of predetermined categories, wherein the predetermined categories correspond to a plurality of processing parameter groups in a one-to-one manner, each of the processing parameter groups comprises a panning angle curve, a separation curve and a weight parameter;

performing a classification step for the input audio signal according to the predetermined categories, wherein the classification step comprises:

classifying the input audio signal according to audio components of the input audio signal to select a plurality of input audio categories from among the predetermined categories; and selecting a plurality of input audio parameter groups from among the processing parameter groups according to the input audio categories, wherein the input audio parameter groups comprises a first input audio parameter group and a second input audio parameter group selected from among the processing parameter groups;

performing a transformation step on the input audio signal to transform the input audio signal to frequency domain, thereby obtaining a amplitude signal and a phase signal corresponding to the input audio signal;

performing a panning step on the amplitude signal according to the input audio categories of the input audio signal, and the input audio parameter groups corresponding to the input audio categories, thereby obtaining a plurality of weighted panning amplitude signals of the input audio signal, wherein the weighted panning amplitude signals comprise a first weighted panning amplitude signal and a second weighted panning amplitude signal, and the panning step comprises:

calculating a first panning curve according to the panning angle curve of the first input audio parameter group;

calculating a second panning curve according to the panning angle curve of the second input audio parameter group;

multiplying the first panning curve by the weight parameter of the first input audio parameter group, thereby obtaining a first weighted panning curve;

multiplying the second panning curve by the weight parameter of the second input audio parameter group, thereby obtaining a second weighted panning curve;

multiplying the amplitude signal by the first weighted panning curve to obtain the first weighted panning amplitude signal; and multiplying the amplitude signal by the second weighted panning curve to obtain the second weighted panning amplitude signal;

performing a separation step on the phase signal according to the input audio categories of the input audio signal and the input audio parameter groups corresponding to the input audio categories, thereby obtaining a plurality of weighted separation phase signals of the input audio signal, wherein the weighted separation phase signals comprise a first weighted separation phase signal and a second weighted separation phase signal, and the separation step comprises:

adding the phase signal to the separation curve of the first input audio parameter group to obtain a first separation phase signal;

adding the phase signal to the separation curve of the second input audio parameter group to obtain a second separation phase signal;

multiplying the first separation phase signal by the weight parameter of the first input audio parameter group to obtain the first weighted separation phase signal; and multiplying the second separation phase signal by the weight parameter of the second input audio parameter group to obtain the second weighted separation phase signal;

adding up the weighted panning amplitude signals to obtain a total amplitude signal;

adding up the weighted separation phase signals to obtain a total phase signal; and performing an inverse transformation step on the total amplitude signal and the total phase signal to obtain an optimized audio signal corresponding to the time domain.

2. The audio processing method of claim 1, wherein the transformation step is Fourier transformation step, and the inverse transformation step is Inverse-Fourier Transformation step.

3. A audio processing method, comprising:

providing an input audio signal, wherein the input audio signal comprises a left channel input signal and a right channel input signal;

providing a plurality of predetermined categories, wherein the predetermined categories correspond to a plurality of processing parameter groups in a one-to-one manner, and each of the processing parameter groups comprises a panning angle curve, a first separation curve, a second separation curve and a weight parameter, wherein the first separation curve corresponds to a left channel, and the second separation curve corresponds to a right channel;

performing a first classification step on the left channel input signal according to the predetermined categories, wherein the first classification step comprises:

classifying the left channel input signal according to audio components of the left channel input signal to select a plurality of left channel categories from among the predetermined categories; and selecting a plurality of left channel parameter groups from among the processing parameter groups according to the left channel categories, wherein the left channel parameter groups comprises a first left channel parameter group and a second left channel parameter group selected from among the processing parameter groups;

performing a second classification step on the right channel input signal according to the predetermined categories, wherein the second classification step comprises:

classifying the right channel input signal according to audio components of the right channel input signal to select a plurality of right channel categories from among the predetermined categories; and selecting a plurality of right channel parameter groups from among the processing parameter groups according to the right channel categories, wherein the right channel parameter groups comprises a first right channel parameter group and a second right channel parameter group selected from among the processing parameter groups;

performing a left channel audio signal adjusting step, comprising:

performing a first transformation step to transform the left channel input signal to frequency domain, thereby obtaining a left channel amplitude signal and a left channel phase signal which correspond to the left channel input signal;

performing a first panning step on the left channel amplitude signal according to the left channel categories of the left channel input signal and the left channel parameter groups corresponding to the left channel categories, thereby obtaining a plurality of left channel weighted panning amplitude signals of the left channel input signal, wherein the left channel weighted panning amplitude signals comprise a first left channel weighted panning amplitude signal and a second left channel weighted panning amplitude signal, and the first panning step comprises:

calculating a first left channel panning curve according to the panning angle curve of the first left channel parameter group;

calculating a second left channel panning curve according to the panning angle curve of the second left channel parameter group;

multiplying the first left channel panning curve by the weight parameter of the first left channel parameter group, thereby obtaining a first left channel weighted panning curve;

multiplying the second left channel panning curve by the weight parameter of the second left channel parameter group, thereby obtaining a second left channel weighted panning curve;

multiplying the left channel amplitude signal by the first left channel weighted panning curve to obtain the first left channel weighted panning amplitude signal; and multiplying the left channel amplitude signal by the second left channel weighted panning curve to obtain the second left channel weighted panning amplitude signal;

performing a first separation step on the left channel phase signal according to the left channel categories of the left channel input signal and the left channel parameter groups corresponding to the left channel categories, thereby obtaining a plurality of left channel weighted separation phase signals of the left channel input signal, wherein the left channel weighted separation phase signals comprise a first left channel weighted separation phase signal and a second left channel weighted separation phase signal, and the first separation step comprises:

adding the left channel phase signal to the separation curve of the first left channel parameter group to obtain a first left channel separation phase signal;

adding the left channel phase signal to the separation curve of the second left channel parameter group to obtain a second left channel separation phase signal;

multiplying the first left channel separation phase signal by the weight parameter of the first left channel parameter group to obtain the first left channel weighted separation phase signal; and multiplying the second left channel separation phase signal by the weight parameter of the second left channel parameter group to obtain the second left channel weighted separation phase signal;

performing a right channel audio signal adjusting step, comprising:

performing a second transformation step to transform the right channel input signal to frequency domain, thereby obtaining a right channel amplitude signal and a right channel phase signal corresponding to the right channel input signal;

performing a second panning step on the right channel amplitude signal according to the right channel categories of the right channel input signal and the right channel parameter groups corresponding to the right channel categories, thereby obtaining a plurality of right channel weighted panning amplitude signals of the right channel input signal, wherein the right channel weighted panning amplitude signals comprise a first right channel weighted panning amplitude signal and a second right channel weighted panning amplitude signal, and the second panning step comprises:

calculating a first right channel panning curve according to the panning angle curve of the first right channel parameter group;

calculating a second right channel panning curve according to the panning angle curve of the second right channel parameter group;

multiplying the first right channel panning curve by the weight parameter of the first right channel parameter group, thereby obtaining a first right channel weighted panning curve;

multiplying the second right channel panning curve by the weight parameter of the second right channel parameter group, thereby obtaining a second right channel weighted panning curve;

multiplying the right channel amplitude signal by the first right channel weighted panning curve to obtain the first right channel weighted panning amplitude signal; and multiplying the right channel amplitude signal by the second right channel weighted panning curve to obtain the second right channel weighted panning amplitude signal;

performing a second separation step on the right channel phase signal corresponding to the right channel categories of the right channel input signal and the right channel parameter groups corresponding to the right channel categories, thereby obtaining a plurality of right channel weighted separation phase signals of the right channel input signal, wherein the right channel weighted separation phase signals comprise a first right channel weighted separation phase signal and a second right channel weighted separation phase signal, and the second separation step comprises:

adding the right channel phase signal to the separation curve of the first right channel parameter group to obtain a first right channel separation phase signal;

adding the right channel phase signal to the separation curve of the second right channel parameter group to obtain a second right channel separation phase signal;

multiplying the first right channel separation phase signal by the weight parameter of the first right channel parameter group to obtain the first right channel weighted separation phase signal; and multiplying the second right channel separation phase signal by the weight parameter of the second right channel parameter group to obtain the second right channel weighted separation phase signal; adding up the first left channel weighted panning amplitude signal and the second left channel weighted panning amplitude signal to obtain a total left channel amplitude signal;

adding up the first right channel weighted panning amplitude signal and the second right channel weighted panning amplitude signal to obtain a total right channel amplitude signal;

adding up the first left channel weighted separation phase signal and the second left channel weighted separation phase signal to obtain a total left channel phase signal;

adding up the first right channel weighted separation phase signal and the second right channel weighted separation phase signal to obtain a total right channel phase signal; and performing a first inverse transformation step on the total left channel amplitude signal and the total left channel phase signal, thereby obtaining an optimized left channel audio signal corresponding to time domain; and performing a second inverse transformation step on the total right channel amplitude signal and the total right channel phase signal, thereby obtaining an optimized right channel audio signal corresponding to time domain.

4. The audio processing method of claim 3, wherein each of the first transformation step and the second transformation step is Fourier transformation step, and each of the first inverse transformation step and the second inverse transformation step is Inverse-Fourier Transformation step.

5. An audio processing system for processing an input audio signal, wherein the input audio signal comprises a left channel input signal and a right channel input signal, wherein the audio processing system comprises:

a classification circuitry configured to store a plurality of processing parameter groups, wherein the processing parameter groups correspond to a plurality of predetermined categories in a one-to-one manner, and each of the processing parameter groups comprises a panning angle curve, a first separation curve which corresponds to a left channel, a second separation curve which corresponds to a right channel and a weight parameter, wherein the classification circuitry is configured to perform a first classification step and a second classification step on the left channel input signal and the right channel input signal, and the first classification step comprises:

classifying the left channel input signal according to audio components of the left channel input signal to select a plurality of left channel categories from among the predetermined categories; and selecting a plurality of left channel parameter groups from among the processing parameter groups according to the left channel categories, wherein the left channel parameter groups comprises a first left channel parameter group and a second left channel parameter group selected from among the processing parameter groups; and the second classification step comprises:

classifying the right channel input signal according to audio components of the right channel input signal to select a plurality of right channel categories from among the predetermined categories; and selecting a plurality of right channel parameter groups from among the processing parameter groups according to the right channel categories, wherein the right channel parameter groups comprises a first right channel parameter group and a second right channel parameter group selected from among the processing parameter groups;

a transformation circuitry configured to perform a respective one of a plurality of transformation steps on each of the left channel input signal and the right channel input signal to transform the left channel input signal and the right channel input signal to a frequency domain respectively, thereby obtaining a left channel amplitude signal and a left channel phase signal which correspond to the left channel input signal, and obtaining a right channel amplitude signal and a right channel phase signal which correspond to the right channel input signal;

a left channel panning circuitry configured to perform a first panning step on the left channel amplitude signal according to the left channel categories of the left channel input signal and the left channel parameter groups corresponding to the left channel categories, thereby obtaining a plurality of left channel weighted panning amplitude signals of the left channel input signal, wherein the left channel weighted panning amplitude signals comprise a first left channel weighted panning amplitude signal and a second left channel weighted panning amplitude signal, and the first panning step comprises:

calculating a first left channel panning curve according to the panning angle curve of the first left channel parameter group;

calculating a second left channel panning curve according to the panning angle curve of the second left channel parameter group;

multiplying the first left channel panning curve by the weight parameter of the first left channel parameter group, thereby obtaining a first left channel weighted panning curve;

multiplying the second left channel panning curve by the weight parameter of the second left channel parameter group, thereby obtaining a second left channel weighted panning curve;

multiplying the left channel amplitude signal by the first left channel weighted panning curve to obtain the first left channel weighted panning amplitude signal; and multiplying the left channel amplitude signal by the second left channel weighted panning curve to obtain the second left channel weighted panning amplitude signal;

a right channel panning circuitry configured to perform a second panning step on the right channel amplitude signal according to angle curve and the at least one right channel weight parameter, thereby obtaining at least the right channel categories of the right channel input signal and the right channel parameter groups corresponding to the right channel categories, thereby obtaining a plurality of right channel weighted panning amplitude signals of the right channel input signal, wherein the right channel weighted panning amplitude signals comprise a first right channel weighted panning amplitude signal and a second right channel weighted panning amplitude signal, and the second panning step comprises:

calculating a first right channel panning curve according to the panning angle curve of the first right channel parameter group;

calculating a second right channel panning curve according to the panning angle curve of the second right channel parameter group;

multiplying the first right channel panning curve by the weight parameter of the first right channel parameter group, thereby obtaining a first right channel weighted panning curve;

multiplying the second right channel panning curve by the weight parameter of the second right channel parameter group, thereby obtaining a second right channel weighted panning curve;

multiplying the right channel amplitude signal by the first right channel weighted panning curve to obtain the first right channel weighted panning amplitude signal; and multiplying the right channel amplitude signal by the second right channel weighted panning curve to obtain the second right channel weighted panning amplitude signal;

a left channel broader circuitry configured to perform a first separation step on the left channel phase signal according to the left channel categories of the left channel input signal and the left channel parameter groups corresponding to the left channel categories, thereby obtaining a plurality of left channel weighted separation phase signals of the left channel input signal, wherein the left channel weighted separation phase signals comprise a first left channel weighted separation phase signal and a second left channel weighted separation phase signal, and the first separation step comprises:

adding the left channel phase signal to the separation curve of the first left channel parameter group to obtain a first left channel separation phase signal;

adding the left channel phase signal to the separation curve of the second left channel parameter group to obtain a second left channel separation phase signal;

multiplying the first left channel separation phase signal by the weight parameter of the first left channel parameter group to obtain the first left channel weighted separation phase signal; and multiplying the second left channel separation phase signal by the weight parameter of the second left channel parameter group to obtain the second left channel weighted separation phase signal;

a right channel broader circuitry configured to perform a second separation step on the right channel phase signal according to the right channel categories of the right channel input signal and the right channel parameter groups corresponding to the right channel categories, thereby obtaining a plurality of right channel weighted separation phase signals of the right channel input signal, wherein the right channel weighted separation phase signals comprise a first right channel weighted separation phase signal and a second right channel weighted separation phase signal, and the second separation step comprises:

adding the right channel phase signal to the separation curve of the first right channel parameter group to obtain a first right channel separation phase signal;

adding the right channel phase signal to the separation curve of the second right channel parameter group to obtain a second right channel separation phase signal;

multiplying the first right channel separation phase signal by the weight parameter of the first right channel parameter group to obtain the first right channel weighted separation phase signal; and multiplying the second right channel separation phase signal by the weight parameter of the second right channel parameter group to obtain the second right channel weighted separation phase signal;

an inverse transformation circuitry, configured to:

add up the first right channel weighted panning amplitude signal and the second right channel weighted panning amplitude signal to obtain a total right channel amplitude signal;

add up the first left channel weighted separation phase signal and the second left channel weighted separation phase signal to obtain a total left channel phase signal;

add up the first right channel weighted separation phase signal and the second right channel weighted separation phase signal to obtain a total right channel phase signal; and perform a first inverse transformation step on the total left channel amplitude signal and the total left channel phase signal, thereby obtaining an optimized left channel audio signal corresponding to time domain; and perform a second inverse transformation step on the total right channel amplitude signal and the total right channel phase signal, thereby obtaining an optimized right channel audio signal corresponding to time domain.

* * * * *